United States Patent [19]

Kowal

[11] Patent Number: 4,694,790

[45] Date of Patent: Sep. 22, 1987

[54] INVERTED BUCKET TAPPET WITH COLLAPSING DIAPHRAGM SEAL

[75] Inventor: Steven J. Kowal, Prospect Heights, Ill.

[73] Assignee: Stanadyne, Inc., Windsor, Conn.

[21] Appl. No.: 900,169

[22] Filed: Aug. 25, 1986

Related U.S. Application Data

[63] Continuation-in-part of Ser. No. 730,195, May 3, 1985, Pat. No. 4,624,225.

[51] Int. Cl.[4] ..... F01L 1/24

[52] U.S. Cl. ..... 123/90.58; 123/90.55

[58] Field of Search ..... 123/90.55, 90.56, 90.57, 123/90.58, 90.59

[56] References Cited

U.S. PATENT DOCUMENTS

| | | | |
|---|---|---|---|
| 4,368,699 | 1/1983 | Kodama | 123/90.58 |
| 4,392,462 | 7/1983 | Lesher | 123/90.55 |
| 4,590,899 | 5/1986 | Kowal et al. | 123/90.58 |

*Primary Examiner*—Ira S. Lazarus

*Attorney, Agent, or Firm*—Kinzer, Plyer, Dorn, McEachran & Jambor

[57] ABSTRACT

A self-contained lash adjuster includes a generally cylindrical cup-shaped follower with a closed end and a lash adjuster cartridge assembly mounted by a spacer within the follower. The cartridge assembly includes a reciprocally movable body and a plunger within the body. There is a high pressure chamber defined between the plunger and the body and there is a plunger passage opening into the high pressure chamber. A check valve controls flow through the plunger passage. A diaphragm-type seal is attached at its outer periphery to an interior wall of the follower and at its inner periphery to the movable body. The seal cooperates with the interior wall of the follower and the body to define a fluid reservoir. The spacer mounting the cartridge assembly is positioned within the reservoir and has openings therein connecting the reservoir with the plunger passage.

6 Claims, 1 Drawing Figure

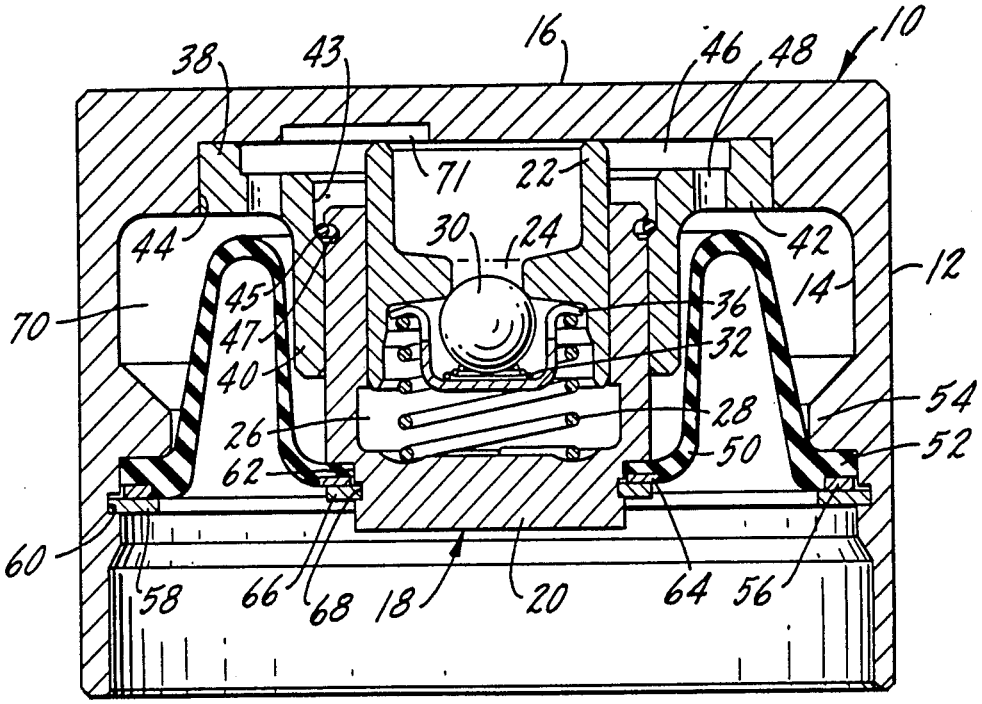
10
16
38
43
46
48
71
22
30
24
44
42
12
14
70
45
47
40
36
32
28
26
50
54
52
62
60
58
66
68
18
20
64
56

INVERTED BUCKET TAPPET WITH COLLAPSING DIAPHRAGM SEAL

This is a continuation-in-part of copending application Ser. No. 730,195, filed May 3, 1985, now U.S. Pat. No. 4,624,225.

SUMMARY OF THE INVENTION

The present invention relates to self-contained hydraulic lash adjusters and in particular to such a lash adjuster utilizing a diaphragm seal to define a fluid reservoir within the lash adjuster.

A primary purpose of the invention is a hydraulic lash adjuster of the type described utilizing a diaphragm seal to define a reservoir which is in communication with the lash adjuster high pressure chamber through an interior spacer which mounts the lash adjuster cartridge assembly.

Another purpose is a lash adjuster of the type described in which the diaphragm seal defining the reservoir within the lash adjuster is free to move and has no restrictions on its movement during lash adjuster operation.

Another purpose is a simply constructed reliably operable self-contained hydraulic lash adjuster of the type described.

Other purposes will appear in the ensuing specification, drawing and claims.

BRIEF DESCRIPTION OF THE DRAWING

The invention is illustrated diagrammatically in the attached axial section through a hydraulic lash adjuster of the type described.

DESCRIPTION OF THE PREFERRED EMBODIMENT

U.S. Pat. No. 4,397,271, assigned to the assignee of the present application, shows a semi-self-contained hydraulic lash adjuster using a diaphragm seal. Application Ser. No. 730,195, filed May 3, 1985, now U.S. Pat. No. 4,624,225 of which the present application is a continuation-in-part, utilizes a diaphragm seal in a self-contained lash adjuster in which the seal defines a fluid reservoir in communication with the lash adjuster high pressure chamber. The seal is fixed to both the movable body forming one element of the lash adjuster cartridge assembly and to the interior wall of the follower. The lash adjuster cartridge assembly is mounted to the follower by a spacer which is outside of the diaphragm seal, thus limiting movement of the diaphragm seal to the area defined by the spacer. The present invention positions the spacer holding the cartridge assembly inside of the diaphragm seal, thus eliminating any possible restrictions on movement of the seal during lash adjuster operation. The diaphragm seal is completely free to expand and contract during operation of the lash adjuster as fluid is moved between the high pressure chamber and the reservoir during normal engine operation.

One of the advantages of a self-contained lash adjuster is that it prevents aerated oil reaching the high pressure chamber in the adjuster, thus reducing the possibility of a noisy tappet or lash adjuster with subsequent malfunction of the combustion engine. However, in such a self-contained lash adjuster it is necessary that the reservoir of hydraulic fluid be permanently and completely sealed so as to prevent loss of fluid. The present invention provides an improved type of diaphragm seal which is firmly attached at its inner and outer peripheries to elements of the lash adjuster so that the fluid reservoir maintains its integrity over the long period of time and long mileage requirements placed on lash adjusters in state-of-the-art engines. The lash adjuster diaphragm seal has no restrictions on its movement and thus there is no possibility of excessive pressures being built up within the reservoir defined by the seal which might rupture the seal and thus cause loss of the hydraulic fluid within its reservoir.

The lash adjuster will be positioned axially above the engine valve and immediately below an overhead cam. The lash adjuster disclosed herein is specifically designed for use in small, efficient internal combustion engines utilizing overhead cams.

In the drawing, the lash adjuster follower is indicated generally at 10 and is a cup-shaped element having an outer wall 12, an interior wall 14 and a closed end 16. Positioned within the interior of follower 10 is a lash adjuster cartridge assembly 18 consisting of plunger 22 and a body 20 which is movable toward and away from follower closed end 16. The plunger is mounted within body 20 and there is a plunger passage 24 which connects to a high pressure chamber 26 formed between the plunger and the body. A coil spring 28 normally urges body 20 away from the plunger or to what it termed as the "extended" position of the lash adjuster cartridge assembly. The extended position is shown in the drawing. A check valve 30 closes passage 24 and is urged toward the closing position illustrated by a coil spring 32 held in position by a retainer 36.

Cartridge assembly 18 is mounted within follower 10 by a spacer indicated generally at 38 which has a cylindrical wall 40 within which body 20 reciprocates and an outwardly-extending flange area 42. Follower 10 has a recess 44 adjacent closed end 16 and spacer 38 is positioned within the recess. Closed end 16 and the flange area 42 of spacer 38 define a space 46 which is in communication with the interior of cartridge assembly 18 through passage 71 and with the area outside of spacer 38 by means of a plurality of circulation holes 48.

The interior of cylindrical wall 40 has a small peripheral recess 43 and the exterior of body 20 carries a retaining ring 45 positioned within a circumferential groove 47. Recess 43 in cooperation with retainer 45 limits the outward movement of body 20 with the inward movement of the body being limited by end wall 16 of the follower.

A diaphragm-type seal is indicated generally at 50 and has its outer periphery formed into a circumferential enlarged area 52 which is attached to follower interior wall 14. The interior wall of the follower has an inwardly-extending peripheral projection or shoulder 54 which supports the enlarged end 52 of the exterior of diaphragm seal 50. A small steel circular insert 56 is positioned within a groove in the enlarged area 52 of the outer periphery of the diaphragm seal, with the steel insert and seal periphery being held in position by a snap ring 58, the outer periphery of which is positioned within a groove 60 in interior wall 14 of follower 10.

The interior periphery of diaphragm seal 50 is similarly attached to body 20. Body 20 has a recess 62 generally adjacent the outer end of the body or that end furthest away from interior wall 16 of the follower. Within recess 62 is positioned a circular steel insert 64 with a snap ring 66 positioned within a body groove 68 holding the assembly together about the exterior of the body.

Diaphragm seal 50 cooperates with the interior wall of the follower and the exterior of body 20 to define a reservoir 70 which is in communication, through circulation holes 48, with space 46 and thus through passage 71 with the interior of the lash adjuster cartridge assembly. Accordingly, fluid within reservoir 70 is in communication and can freely flow between the reservoir and high pressure chamber 26 within the lash adjuster cartridge assembly.

The diaphragm seal has an unflexed radial length or distance which is substantially greater than the actual distance between the interior of the follower and the exterior of the cartridge assembly. During engine operation, when hydraulic fluid will be freely exchanged between the reservoir and the high pressure chamber, the size of the diaphragm seal will expand and there is no restriction or limitation on such expansion, as the spacer is positioned within the reservoir and inside of the seal.

The material of seal 50 is important, as it must withstand the temperatures and operating conditions associated with lash adjuster utility and it must be resistant to the silicone compositions which are included in hydraulic fluid. A material sold under the trademark VAMAC has been found to be one satisfactory material. The material must have a degree of stretch or elasticity. When the lash adjuster body is in the non-extended position hydraulic fluid from high pressure chamber 26 is moved into reservoir 70 which has the effect of stretching the seal. The seal must permit such stretch and have a degree of resilience such that when the body moves to the lash adjuster extended position, the resiliency of the diaphragm seal will assist in urging fluid from reservoir 70 back into the high pressure chamber. There must be sufficient fluid pressure differential between reservoir 70 and chamber 26 to move the check valve away from its seat so that fluid passing from the reservoir through openings 48 can in fact return to the high pressure chamber.

By positioning the seal outside of the spacer, any inhibitions or limitations or restrictions on movement of the diaphragm seal are eliminated. The spacer is compact and tightly holds the lash adjuster cartridge assembly within the follower and the diaphragm seal is positioned exteriorly of the spacer.

Whereas the preferred form of the invention has been shown and described herein, it should be realized that there may be many modifications, substitutions and alterations thereto.

The embodiments of the invention in which an exclusive property or privilege is claimed are defined as follows:

1. A self-contained lash adjuster including a generally cylindrical cup-shaped follower having a closed end, a lash adjuster cartridge assembly, a spacer mounting said cartridge assembly within said follower, said cartridge assembly including a reciprocally movable body and a plunger within said body, a high pressure chamber defined between said plunger and body, a plunger passage opening into said high pressure chamber, a check valve controlling flow through said plunger passage, and a diaphragm-type seal attached at its outer periphery to an interior wall of said follower and attached at its inner periphery to the movable body, said seal cooperating with the interior wall of said follower and said body to define a fluid reservoir, said spacer being positioned within said reservoir and having openings therein to connect said reservoir with the plunger passage.

2. The lash adjuster of claim 1 further characterized in that said spacer is positioned adjacent said follower closed end and has a cylindrical portion extending along and supporting the exterior of said reciprocally movable body.

3. The lash adjuster of claim 2 further characterized by and including a recess in said follower adjacent said closed end, said spacer being seated in said recess and defining, with said follower closed end, a space which is in communication with said reservoir through said spacer openings and with the interior of said cartridge assembly.

4. The lash adjuster of claim 2 further characterized by and including cooperating stop means on the exterior of said movable body and the interior of said spacer cylindrical portion limiting movement of said body.

5. The lash adjuster of claim 1 further characterized in that the interior of said follower includes an inwardly-directed annular projection, generally intermediate opposite ends of said follower, said diaphragm seal being attached to the interior wall of said follower at said projection.

6. The lash adjuster of claim 5 further characterized in that the exterior of said movable body, generally adjacent the end away from said follower closed end, has a recess, with the inner periphery of said seal being attached to said body at said recess.

* * * * *